US010506891B2

(12) United States Patent
Prusack et al.

(10) Patent No.: US 10,506,891 B2
(45) Date of Patent: Dec. 17, 2019

(54) FASTENER PULL ASSIST APPARATUS

(71) Applicant: CHICSHOP, INC., New York, NY (US)

(72) Inventors: Carine Prusack, New York, NY (US); Michael Morton, Austin, TX (US)

(73) Assignee: CHICSHOP, INC., New York, NY (US)

( * ) Notice: Subject to any disclaimer, the term of this patent is extended or adjusted under 35 U.S.C. 154(b) by 0 days.

(21) Appl. No.: 16/251,806

(22) Filed: Jan. 18, 2019

(65) Prior Publication Data

US 2019/0216182 A1 Jul. 18, 2019

Related U.S. Application Data

(60) Provisional application No. 62/618,963, filed on Jan. 18, 2018.

(51) Int. Cl.

| | |
|---|---|
| ***A47G 25/90*** | (2006.01) |
| ***A44B 19/28*** | (2006.01) |
| ***A63H 3/00*** | (2006.01) |
| ***A44B 19/26*** | (2006.01) |

(52) U.S. Cl.

CPC ..... *A47G 25/902* (2013.01); *A44B 19/262* (2013.01); *A44B 19/285* (2013.01); *A63H 3/003* (2013.01)

(58) Field of Classification Search

CPC ..... A45F 5/004; A47G 25/902; A44B 19/262; A44B 19/285; A63H 3/003

USPC ..... 294/3.6, 219

See application file for complete search history.

(56) References Cited

U.S. PATENT DOCUMENTS

| | | | | | |
|---|---|---|---|---|---|
| 1,270,106 | A * | 6/1918 | Bishop | B65H 75/4434 | 242/385.1 |
| 2,908,057 | A * | 10/1959 | Blanco | A47G 25/902 | 223/111 |
| 2,965,945 | A * | 12/1960 | Lazich | A47G 25/902 | 24/332 |
| 4,067,487 | A * | 1/1978 | Carr | A44B 19/262 | 223/111 |
| 4,202,510 | A * | 5/1980 | Stanish | A01K 27/004 | 242/384.7 |
| 5,136,758 | A * | 8/1992 | Wilcox | A44B 19/262 | 24/16 PB |

(Continued)

OTHER PUBLICATIONS

ISA/U.S., PCT International Search Report and Written Opinion issued for International Application No. PCT/US2019/014154 dated Apr. 4, 2019.

*Primary Examiner* — Dean J Kramer

(74) *Attorney, Agent, or Firm* — Gottlieb, Rackman & Reisman, PC

(57) ABSTRACT

A fastener pull assist apparatus arranged within a housing that is configured to assist in sealing a zipper at the back of a garment, such as a dress. The fastener pull assist apparatus includes a housing, a spooling mechanism arranged within the housing and a fastening assembly that is fixed to the spooling mechanism and releasably fixable to an object to aid in pulling the object. The spool mechanism can include a spool about which a cord is windable, a spool plate that is fixable to the spool, a retraction button that is arranged between the spool and the spool plate, a cap that is contactable with the spool plate and a plurality of springs.

16 Claims, 16 Drawing Sheets

(56) References Cited

U.S. PATENT DOCUMENTS

| | | | | |
|---|---|---|---|---|
| 5,173,067 | A * | 12/1992 | Biba | B63C 11/26 242/156 |
| 5,388,877 | A * | 2/1995 | Wenk | B65H 75/406 224/162 |
| 5,918,658 | A | 7/1999 | Schartner | |
| 6,243,921 | B1 | 6/2001 | Chang | |
| 6,641,390 | B2 * | 11/2003 | Genuise | A45F 5/004 206/87 |
| 6,904,872 | B2 * | 6/2005 | Muller | A01K 27/004 119/789 |
| 8,714,605 | B1 | 5/2014 | Coratola et al. | |
| 9,146,073 | B1 | 9/2015 | Roy | |
| 2004/0045851 | A1 | 3/2004 | Watari | |
| 2008/0022936 | A1 | 1/2008 | Stone et al. | |
| 2017/0099972 | A1 | 4/2017 | Burton | |

* cited by examiner

FASTENER PULL ASSIST APPARATUS

CROSS-REFERENCE TO RELATED APPLICATION

This patent application claims benefit under 35 U.S.C. § 120 to U.S. Provisional Patent Application No. 62/618,963, filed Jan. 18, 2018, which is hereby incorporated by reference in its entirety as part of the present disclosure.

FIELD OF THE INVENTION

The invention generally relates to a device to assist in closing or sealing a fastener and more specifically to a fastener pull apparatus that is affixable to a slidable fastener located on a rear side of a garment to assist in sealing the garment.

BACKGROUND OF THE INVENTION

Fastening mechanisms, such as zippers, have long been included on garments to aid in releasably binding edges of an opening of the garment together. Zippers typically include a first and second portion of tape from which teeth protrude, a slider that facilitates the joining of the teeth and a pull-tab that extends from the slider and can be pulled by an individual to aid in moving the slider along the teeth.

On some garments, such as dresses, zippers are fixed to edges of fabric at the rear of the dress. It can be challenging for an individual wearing the dress to grasp and move the pull-tab along the teeth without having to, for example, contort their body, request assistance or, where possible, rotate the dress so that the zipper can be closed and then readjust the dress to the intended orientation on the individual's body. In other instances, where the individual can reach the zipper, due to the angle at which they must grasp the zipper, they risk possibly damaging the garment and/or zipper.

Devices designed for extending/retracting, ratcheting and spooling in general are known. However, these devices typically have undesirable drawbacks. For example, one known ratcheting mechanisms can produce an undesirable noise when a cord is pulled due to the interaction of the parts of said mechanism. Another known ratcheting mechanism requires pressure to be applied thereto to prevent rotation of a spool and in turn extension or retraction of a cord. As will be described in detail below, the present invention overcomes drawbacks of these devices by allowing for control of both the extension and retraction of a cord with a clip attached to one end of the cord.

SUMMARY OF THE INVENTION

The present invention is directed to a fastener (e.g., zipper) pull apparatus that is arranged within a housing (e.g., figurine) and that is configured to assist in sealing a slidable fastener (e.g., zipper) at the back of a garment (e.g., dress).

In general, the fastener pull apparatus is a spring-loaded, ratcheting, winding mechanism that allows for the extension and retraction of a cord, cable or the like. In an embodiment, a clasp can be fixed to the cord external of the housing. The cord can be freely pulled out of the housing, which is part of the fastener pull apparatus and retracted therein by depressing a button that is part of the fastener pull apparatus up to about ⅔ of a possible travel distance of the button. If the button is depressed fully, the cord is be precluded from extending or from retracting within the housing.

The fastener pull apparatus includes a plurality of elements that work together to allow for the extension and retraction of a cord from the housing. These elements include a spool, a spool plate that is fixable to the spool, a retraction button that is arranged between the spool and the spool plate, a plurality of springs, a cap and a shaft that extends from the housing through openings in the spool, retraction button, spool plate and cap and is configured to receive and/or interaction with the plurality of springs. The cord is wound about the spool and extendable through an opening in the housing. The end of the cord that extends through the housing is fixable to a fastener, such as a clasp, that is configured to be releasably secured to a fastening mechanism to aid in binding edges of an opening of the garment together.

In operation, the cord and/or clasp can be pulled to extend the cord to a desired length from the housing. When the cord is extended from the housing, the spool rotates and in turn winds one of the springs (i.e., the clock spring) that is part of the fastening apparatus, this increases tension on the apparatus. Retraction of the cord is prevented by the interaction of a first coil spring and the retraction button. The first coil spring, which sits within the shaft, is configured to contact and apply pressure on the retraction button. The retraction button includes a plurality of ramps or teeth that project therefrom. Similarly, the spool plate has a plurality of ramps or teeth that are configured to interact with the ramps or teeth of the retraction button. Due to the pressure applied on the retraction button, the ramps or teeth of the retraction button and spool plate remain in contact with each other. The spool plate is fixed to the spool. Because the spool plate cannot rotate due to the interaction of ramps or teeth of the retraction button interaction with mating ramps or teeth of the spool plate, the spool plate prevents the spool from rewinding and the cord from retracting.

When the cap is depressed about ⅔ of a possible total travel, the second spring, which has a spring force greater than the first spring, applies pressure on the retraction button, forcing the retraction button away from the spool plate such that the ramps or teeth of the retraction button and spool plate are no longer interacting with each other and in turn releases the tension on the system. This allows the cord to retract within the housing.

The cap is prevented from rotating due to the interaction of a plurality of teeth extending out from the side of the cap into corresponding grooves arranged longitudinally along the button shaft in the rear housing. If the cap is depressed fully, the spool is prevented from rotating and the cord is prevented from retracting or extending due to an interaction of at least one stop extending from the cap with at least one projection extending from the spool plate. The interaction of the stop and projection lock the spool plate in place. The spool plate is fixed to the spool and therefore the interaction of the stop of the cap and projection of the spool plate preclude rotation of the spool.

The clasp, which is affixed to an end of the cord external of the housing, is configured to be releasably attached to a fastener such as a zipper, pull-tab or the like to aid in sealing the fastener. Upon the fastener being sealed, the clasp is released from the fastener and the cord can be retracted within the housing.

In an embodiment, the present invention is directed to a fastener pull assist apparatus that comprises a housing, a spooling mechanism that is arranged within the housing and a fastening assembly that is fixed to the spooling mechanism and releasably fixable to an object to aid in pulling the object.

The housing can include a front housing member and a rear housing member that are fixable to each other. The front housing member can include a shaft extending therefrom that has a first projection and a second projection that is spaced from the first projection such that a cavity is formed between the first projection and the second projection.

The spool mechanism can include a spool about which a cord is windable, a spool plate that is fixable to the spool, a retraction button that is arranged between the spool and the spool plate, a cap that is contactable with the spool plate and a plurality of springs. The plurality of springs can include a first spring, a second spring and a third spring. The first spring can be a coil spring, the second spring can be a coil spring that has a spring rate that is greater than that of the first spring and the third spring can be a clock spring.

The spool, the retraction button, the spool plate can have an opening extending therethrough and the cap can have an opening extending therein and the shaft can be configured to extend through the opening of the spool, the retraction button, the spool plate and into the opening of the cap to align the spool, the retraction button, the spool plate and the cap in relation to each other about an axis.

The spool can include a cylindrical sidewall that has a first surface and a second surface that is mirror opposite the first surface and a wall extending from the second surface, dividing an interior of the spool into a first cavity and a second cavity.

The retraction button can include a hub that has a first slotted opening and a second slotted opening and a flange that includes a plurality of ramps.

The spool plate can include a body that that has a plurality of ramps that extend from a first surface, at least one fastener that extends from the first surface and at least one projection extending from a second surface.

The cap can include a housing, a flange extending from an end of the housing, a plurality of teeth extending radially out from the flange and at least one stop extending longitudinally from the flange.

In an embodiment, the present invention is directed to a fastener pull assist apparatus that comprises a first housing that has a shaft extending therefrom, a second housing that is configured to be connectable with the first housing and form a cavity therein and a spool system that is arranged between the first housing and the second housing and that includes a spool about which a cord is windable, a spool plate fixed to the spool, a retraction button arranged between the spool and the spool plate, a cap configured to interact with the spool plate and a plurality of springs. The housing can be part of a decorative element.

The shaft can include a first projection and a second projection that is spaced from the first projection such that a cavity exists between the first projection and the second projection.

In an assembled first state, one of the plurality of springs can be arranged within the cavity of the shaft and contactable with the retraction button and in turn the retraction button can be contactable with the spool plate, allowing for rotation of the spooling mechanism in only a first direction. In a second state, upon partial depression of the cap, the retraction button can be spaced from the spool plate, permitting the spool to rotate in a second direction. In a third state, upon full depression of the cap, the cap can contact and interact with the spool plate, preventing rotation of the spool in either the first or second direction.

In an embodiment, the present invention is directed to a method of moving a slidable fastener that comprises the steps of: providing a housing and a spool system arranged within the housing that includes a spool about which a cord is windable, a spool plate fixed to the spool, a retraction button arranged between the spool and the spool plate, a cap configured to interact with the spool plate and a plurality of springs; pulling the cord to extend a length of the cord exterior of the housing; depressing the cap partially to retract the cord within the housing; and depressing the cap fully to prevent rotation of the spool and in turn retraction or extension of the cord.

DETAIL DESCRIPTION OF EMBODIMENTS OF THE INVENTION

Figure 1:
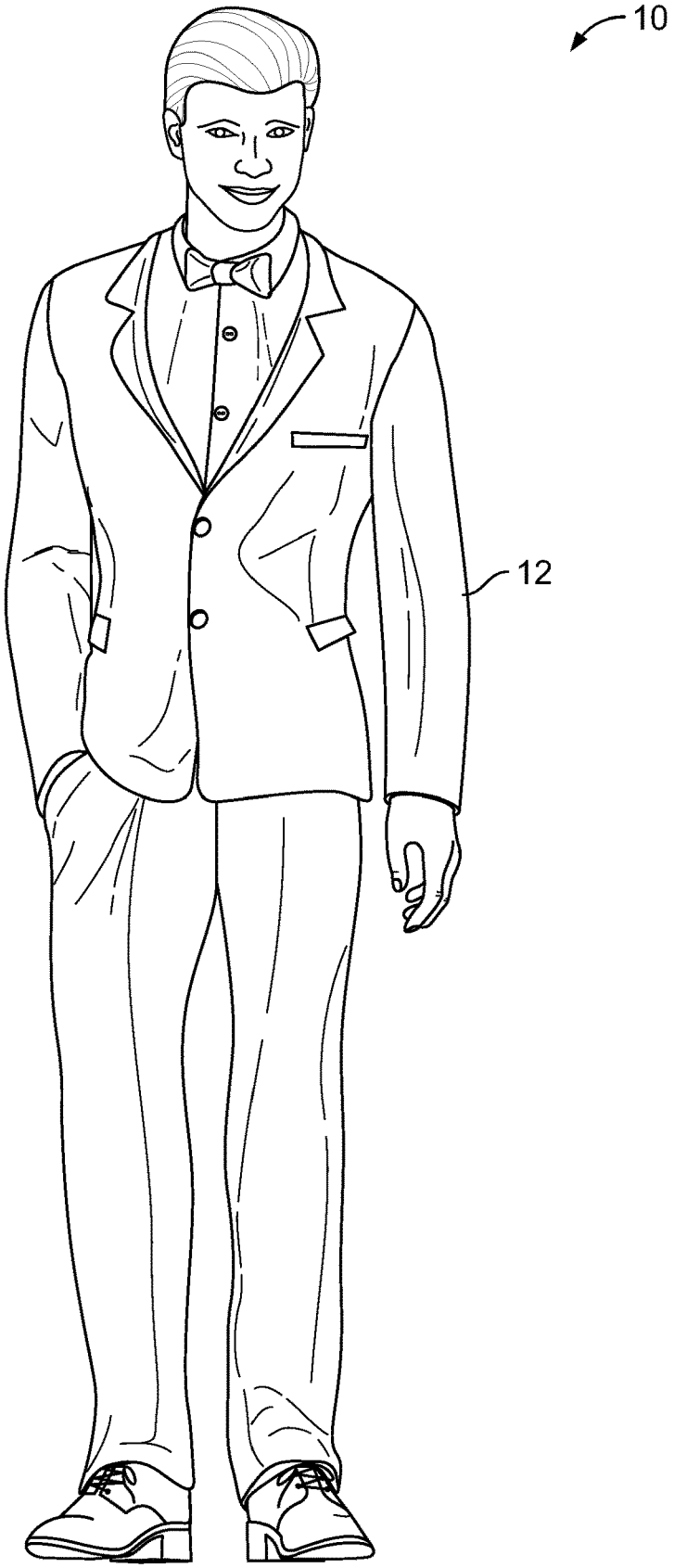
FIG. 1 is a front perspective view of a fastener pull assist apparatus according to an exemplary embodiment of the present invention.
Figure 2:
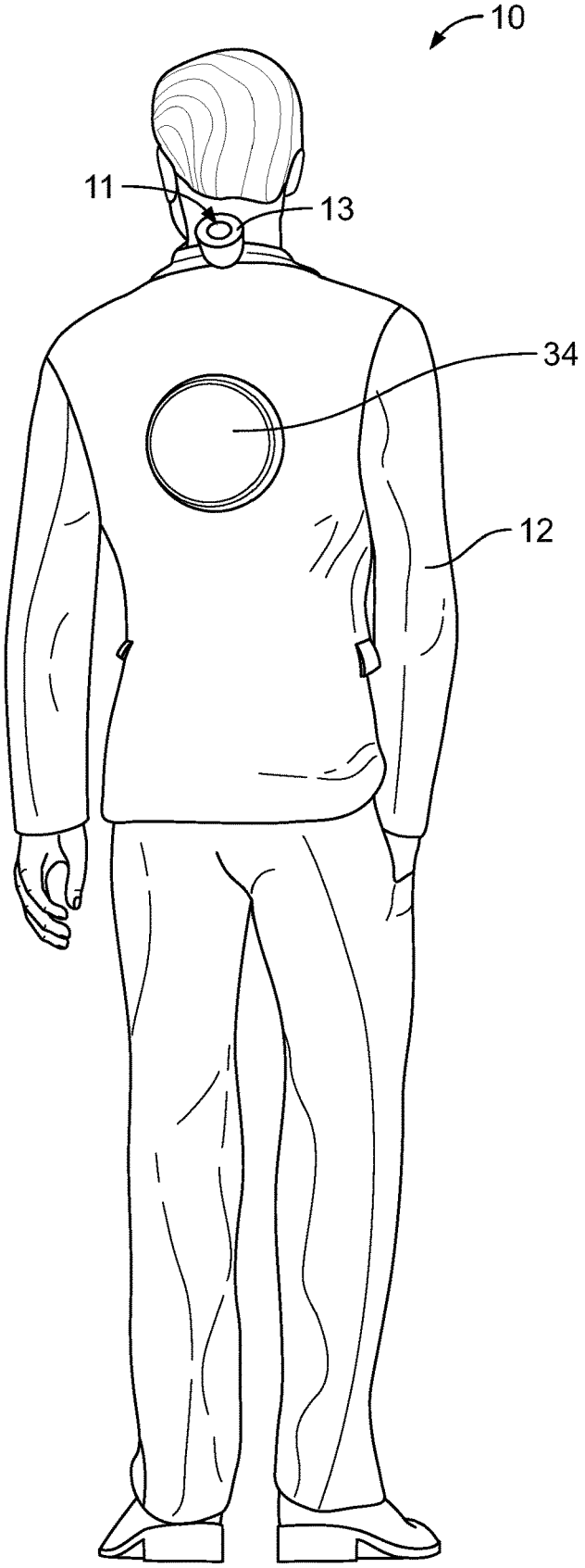
FIG. 2 is a rear perspective view of the fastener pull assist apparatus according to an exemplary embodiment of the present invention.
Figure 3:
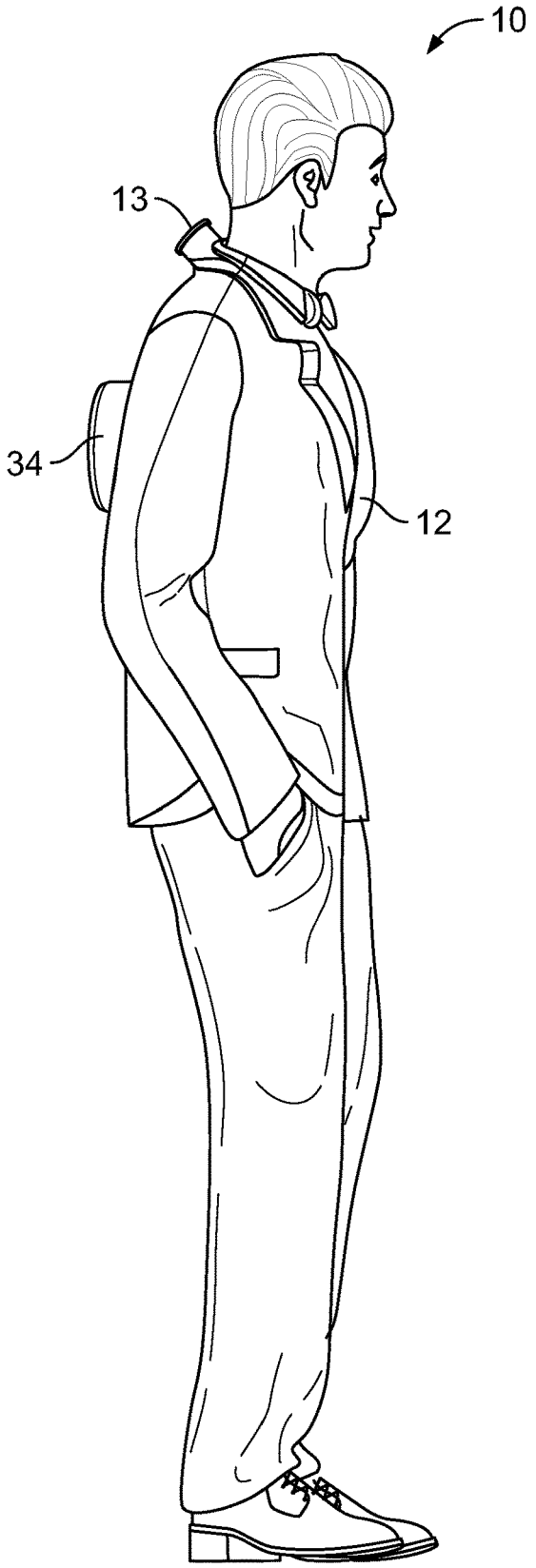
FIG. 3 is a right side perspective view of the fastener pull assist apparatus according to an exemplary embodiment of the present invention.
Figure 4:
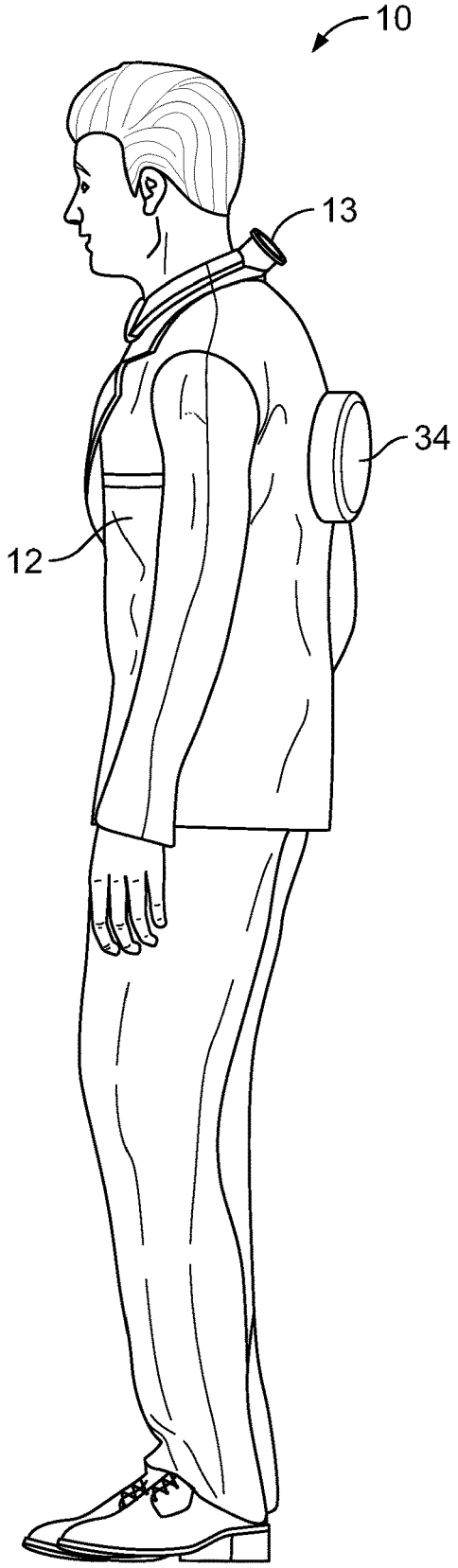
FIG. 4 is a left side perspective view of the fastener pull assist apparatus according to an exemplary embodiment of the present invention.

With reference now to the drawings, and in particular to FIGS. 1 through 18D, embodiments of a fastener pull apparatus 10 embodying the principles and concepts of the present invention will be described.

FIGS. 1-4 show various views of a housing 12 in which the fastener pull apparatus 10 is arranged. The housing 12 is incorporated as part of a decorative element. It is noted that although, shown in the figures, the housing 12 is incorporated into a male figurine, the housing 12 should not be limited to being part of said figurine and can be part of a female figurine, an object, an animal, a character, a shape, etc.

In general, the fastener pull apparatus 10 is a spring-loaded, ratcheting, winding mechanism that allows for the extension and retraction of a cord 14. In an embodiment, a clasp 15 can be fixed to the cord 14 external of the housing 12. The cord 14 can be freely pulled out of the housing 12 and retracted therein by partially depressing a button 34 (i.e., up to about ⅔ of a possible travel distance of the button 34). If the button 34 is depressed fully, the cord 14 can be precluded from extending from retracting within the housing 12. It is noted that the cord 14 can extend through a tube 13 (see FIG. 2) that can be fixable to the housing 12.

As will be described in detail below and can be seen, for example, in FIGS. 5-8, the fastener pull apparatus 10 includes a plurality of elements that work together to allow for the releasable extension and retraction of a cord 14 through an opening 13 in the housing 12. These elements include a front housing 16, a shaft 18 that extends from an inner surface 20 of the front housing member 16, a flat coil or clock spring 22, a first coil spring 24, a spool 26, a retractable button 28, a spool plate 30, a second coil spring 32, a cap 34 and a rear housing member 36 that includes an opening 41 to allow the cap 34 to extend therethrough.

Figure 9:
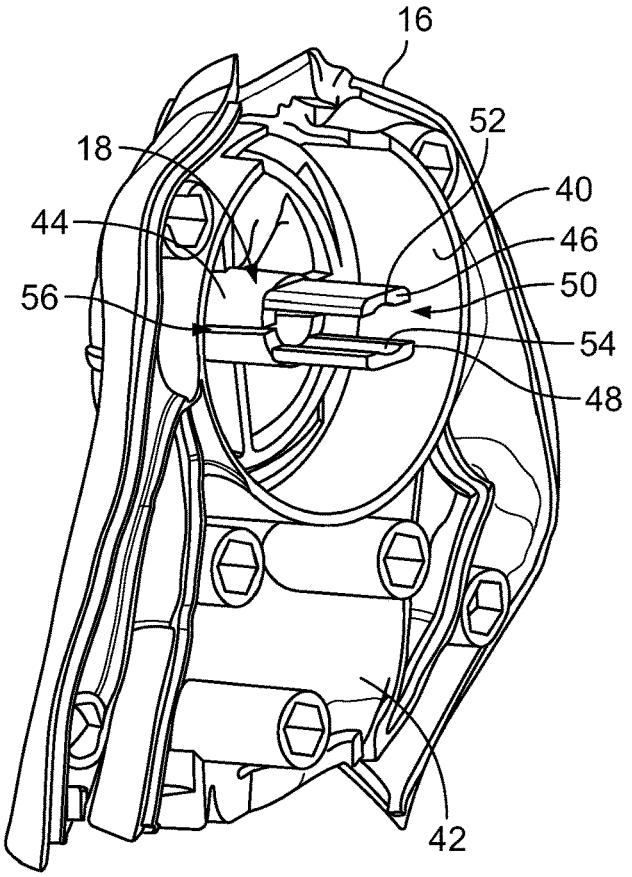
FIG. 9 is a rear perspective view of a portion of a front body portion of the fastener pull assist assembly according to an exemplary embodiment of the present invention.
Figure 10:
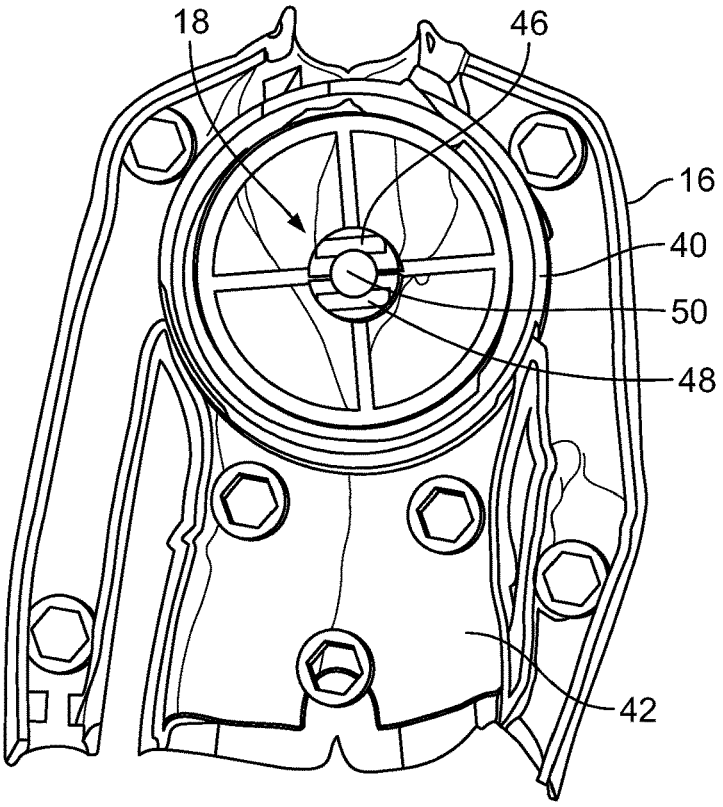
FIG. 10 is a rear view of a portion of a front body portion of the fastener pull assist assembly according to an exemplary embodiment of the present invention.

As illustrated, for example, in FIGS. 9 and 10, the front housing 16 includes a sidewall 40 that extends from the rear side 42 thereof and is configured to substantially retain many elements of the fastener pull apparatus 10 therein in an assembled state. The shaft 18, which is centrally located within the sidewall 40, extends directly from the rear of the front housing 16. The shaft 18 includes a base 44, a first projection 46 that extends from the base 44 and a second projection 48 that is spaced from the first projection 46 such that a gap 50 exists between the first and second projections 46, 48 and extends from the base 44. The first projection 46 and the second projection 48 each include a groove 52, 54, respectively. As can be seen in FIG. 9, a channel 56 extends along the base 44 between the first and second projections 46, 48 to aid in securing a first end 58 of the flat coil or clock spring 22 within the housing 12. As shown in FIGS. 9 and 10, the shaft 18, the sidewall 40 and the front housing member 16 are a one-piece molded element. However, it is contemplated that at least some of these elements of the fastening pull apparatus 10 can be independent elements of each other.

Figure 11:
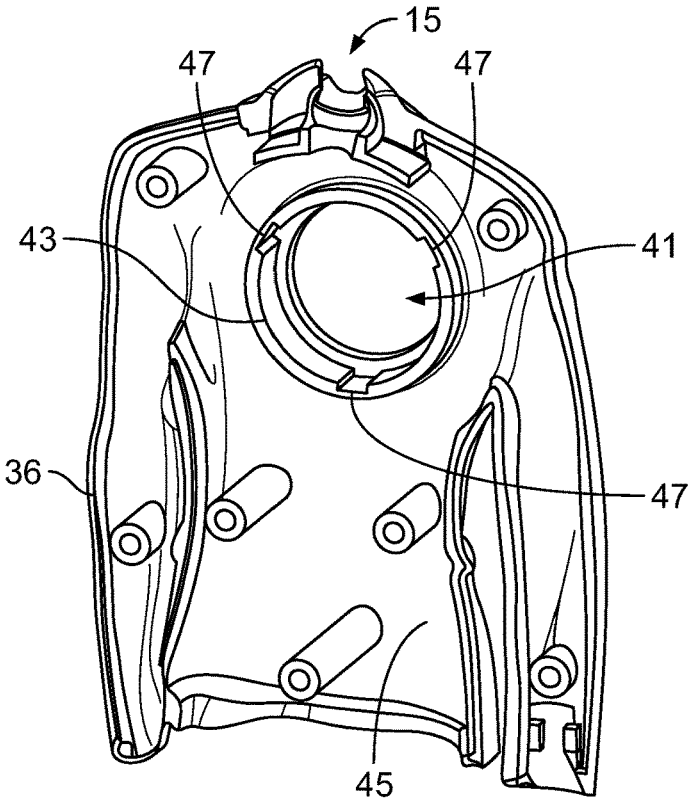
FIG. 11 is a rear perspective view of a portion of a rear body portion of the fastener pull assist assembly according to an exemplary embodiment of the present invention.
Figure 12:
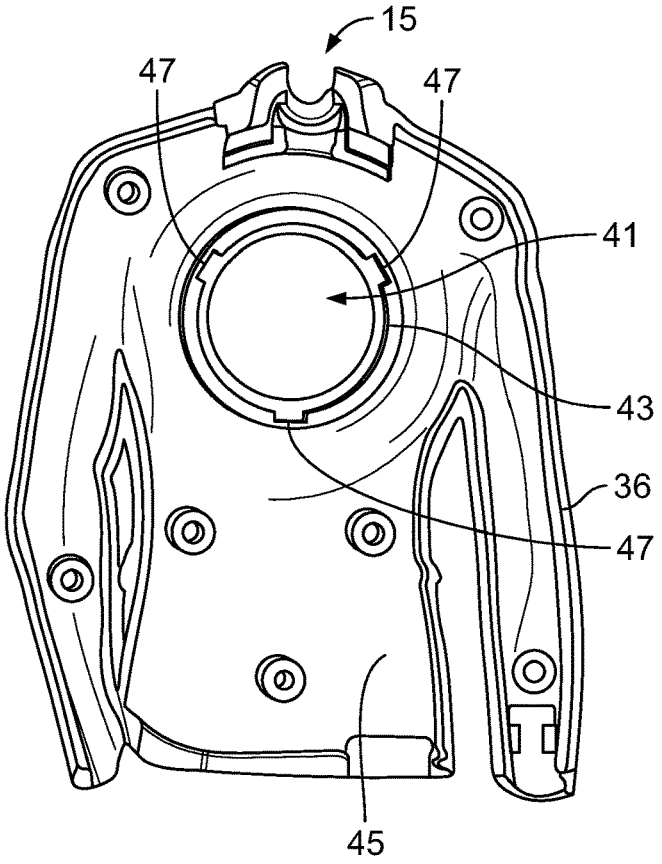
FIG. 12 is a rear view of a portion of a rear body portion of the fastener pull assist assembly according to an exemplary embodiment of the present invention.
Figure 13:
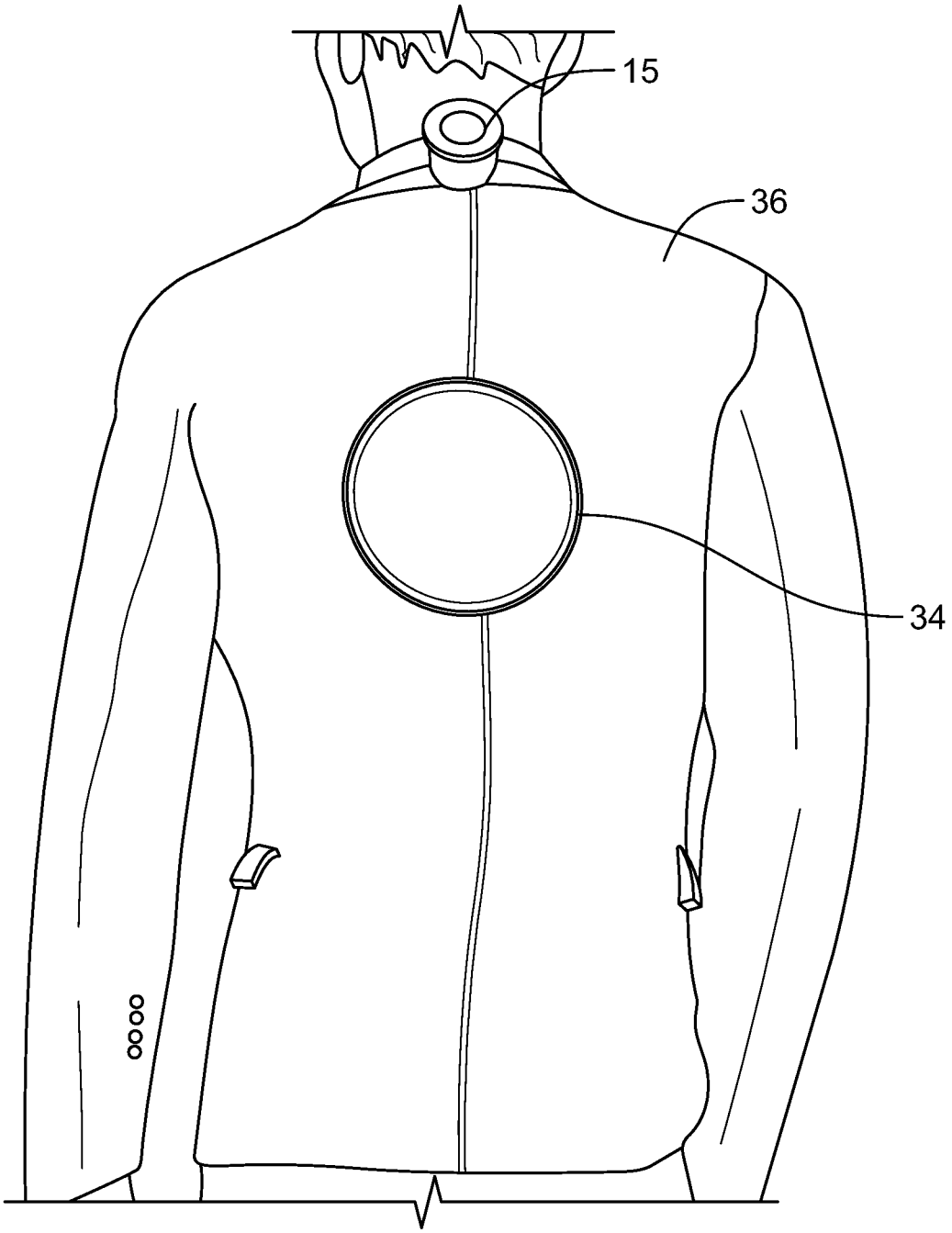
FIG. 13 a rear perspective view of a portion of a rear body portion of the fastener pull assist assembly with the button cap protruding therethrough according to an exemplary embodiment of the present invention.
Figure 14A:
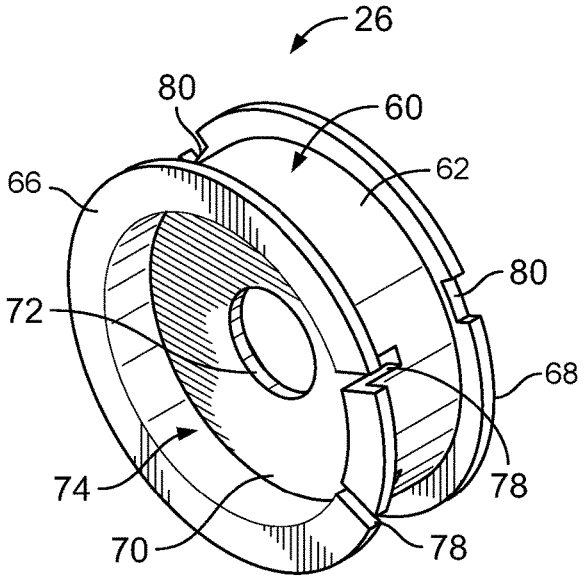
FIGS. 14A-14D are views of the spool according to an exemplary embodiment of the present invention.
Figure 14B:
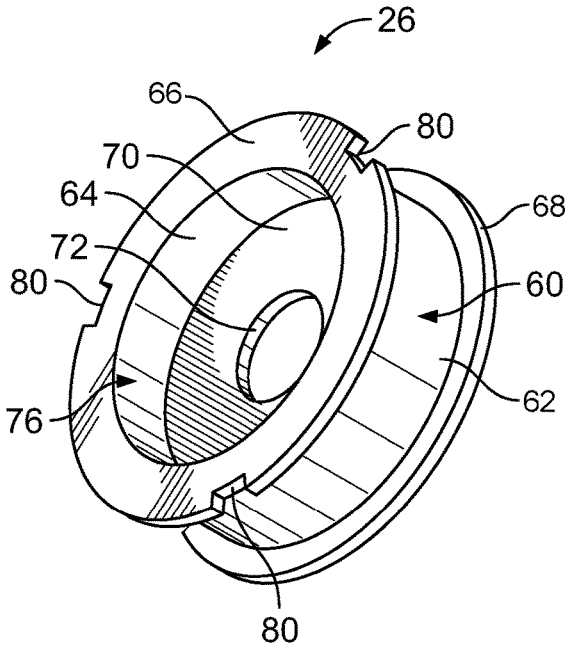
Figure 14C:
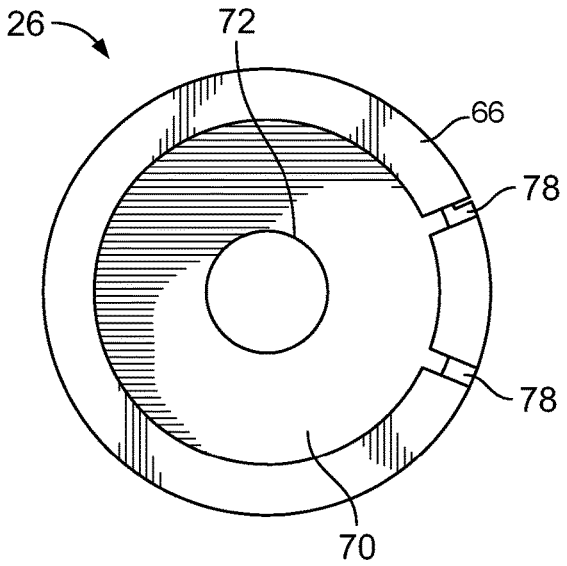
Figure 14D:
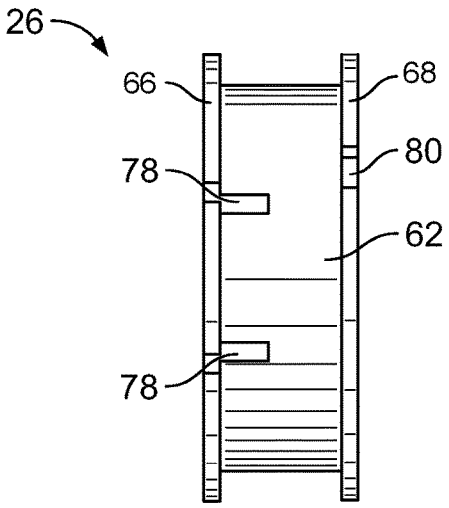
Figure 15A:
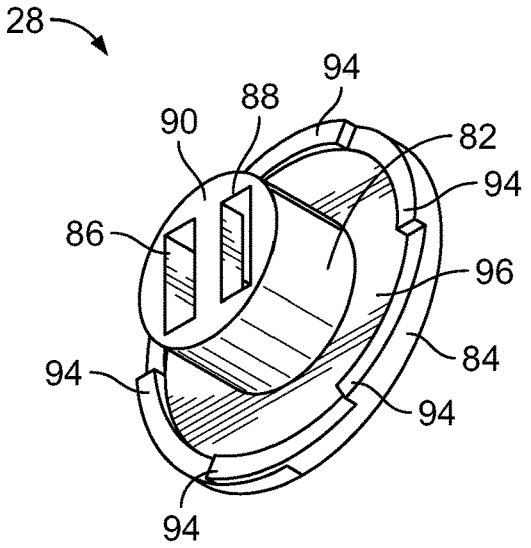
FIGS. 15A-15F are views of the retracting button according to an exemplary embodiment of the present invention.
Figure 15B:
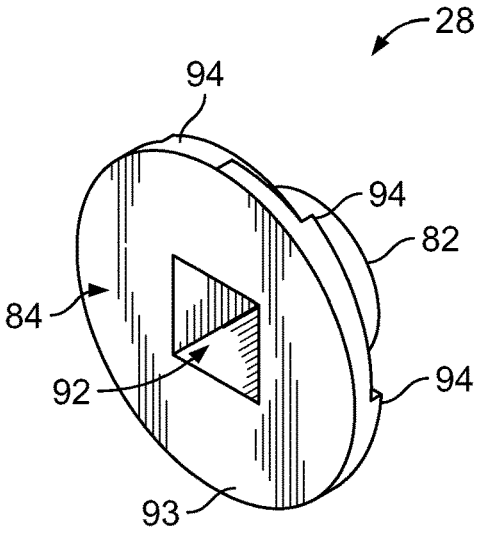
Figure 15C:
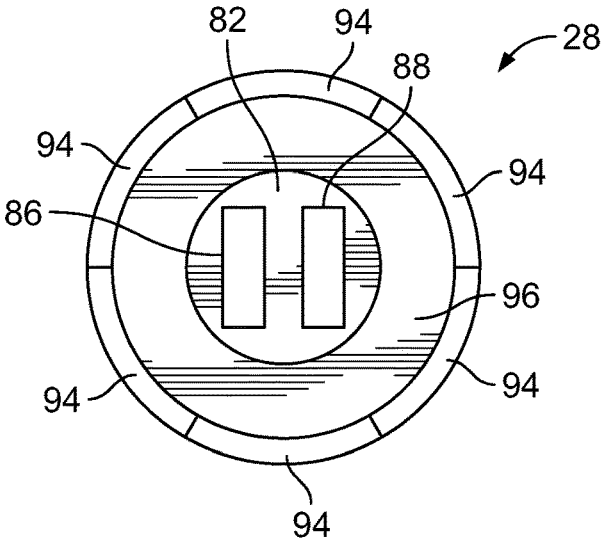
Figure 15D:
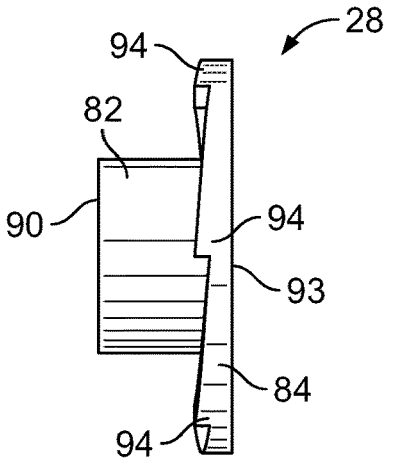
Figure 15E:
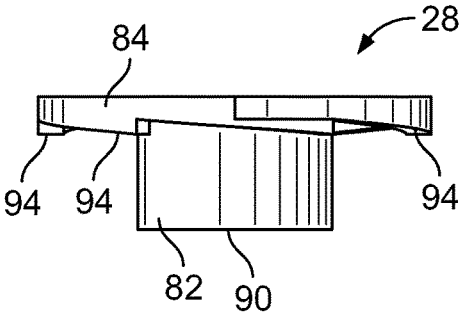
Figure 15F:
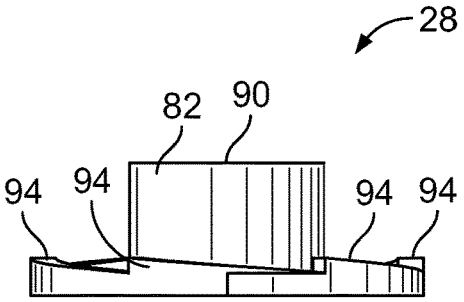
Figure 16A:
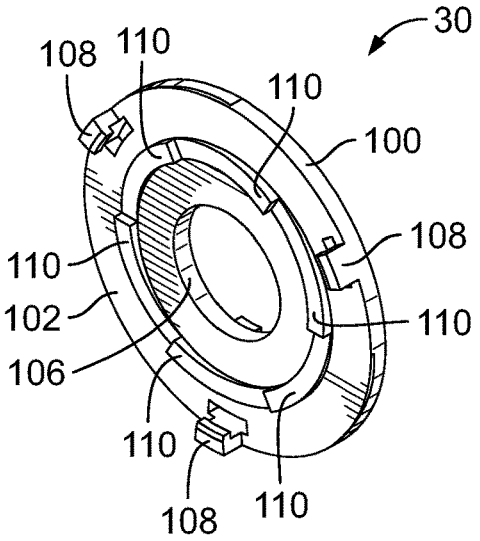
FIGS. 16A-16F are views of the spool plate according to an exemplary embodiment of the present invention.
Figure 16B:
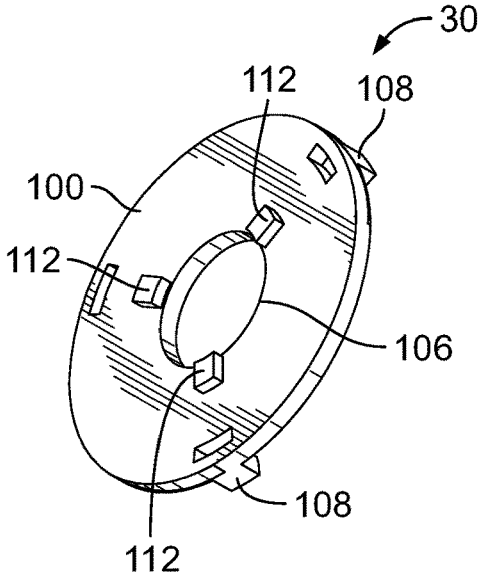
Figure 16C:
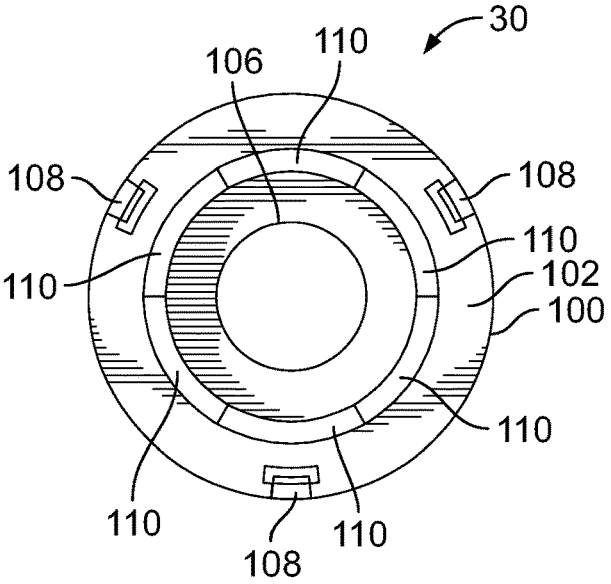
Figure 16D:
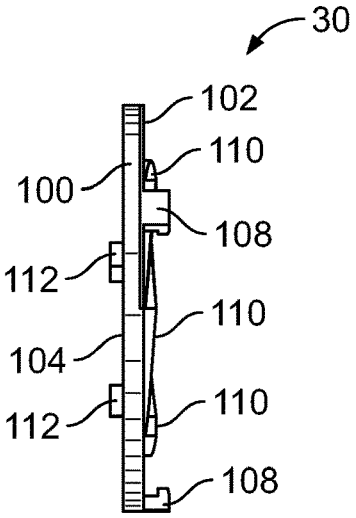
Figure 16E:
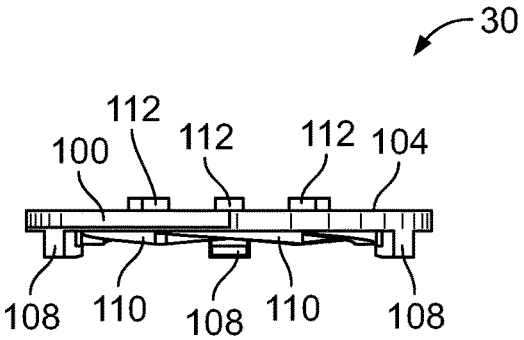
Figure 16F:
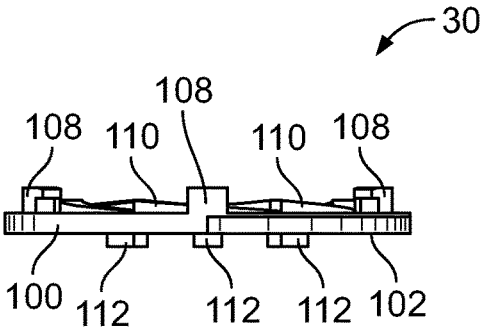
Figure 17A:
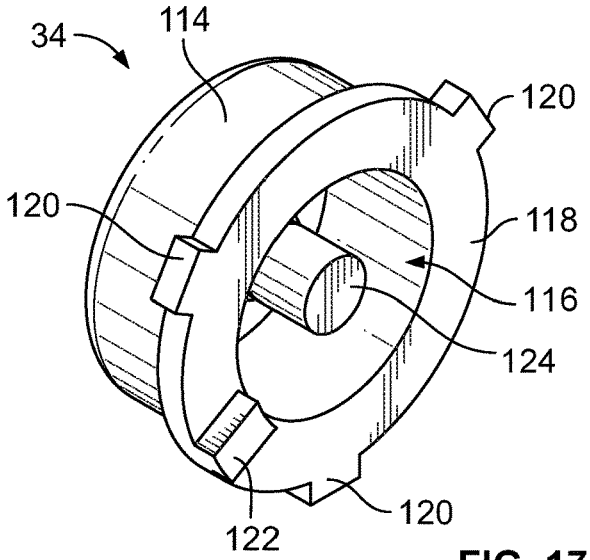
FIGS. 17A-17E are views of the button cap according to an exemplary embodiment of the present invention.
Figure 17B:
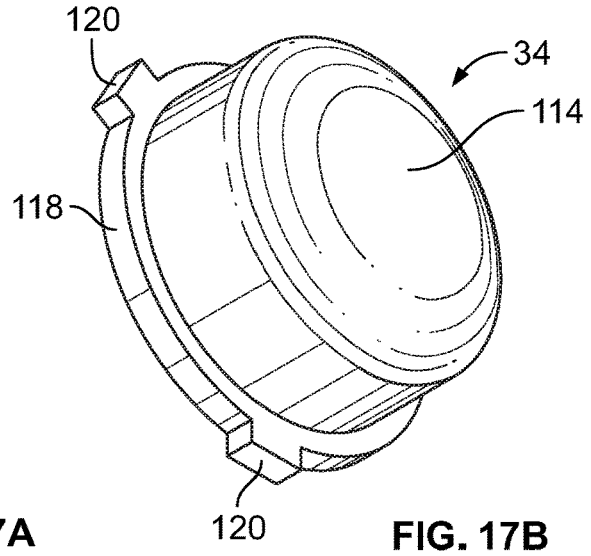
Figure 17C:
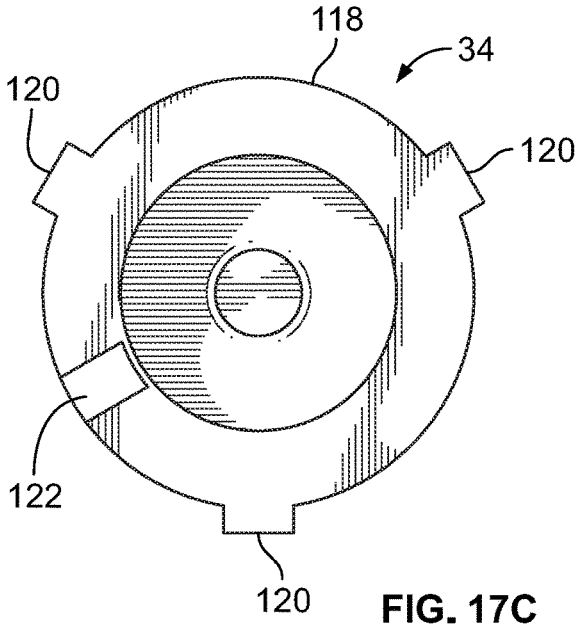
Figure 17D:
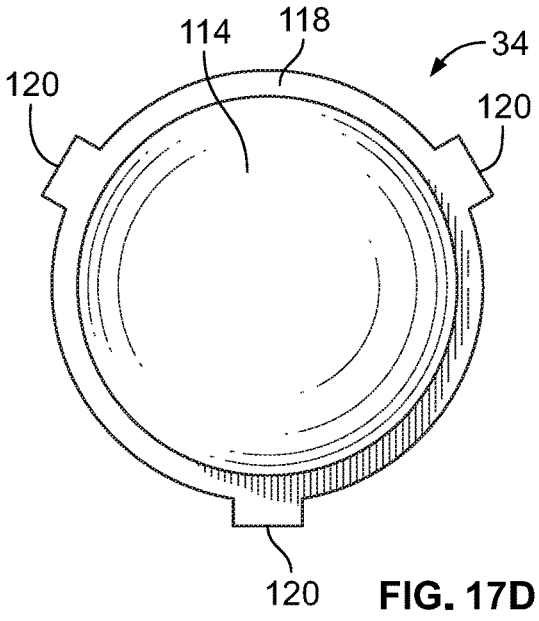
Figure 17E:
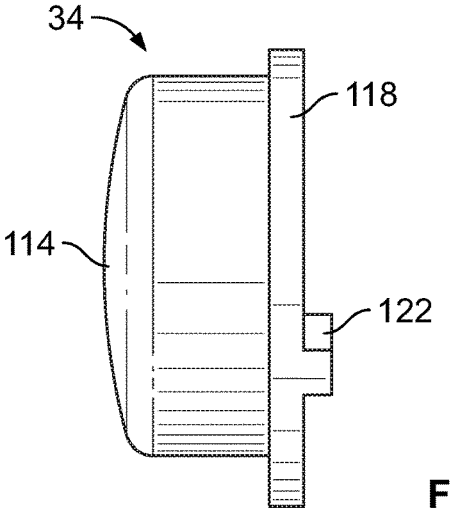
Figure 18A:
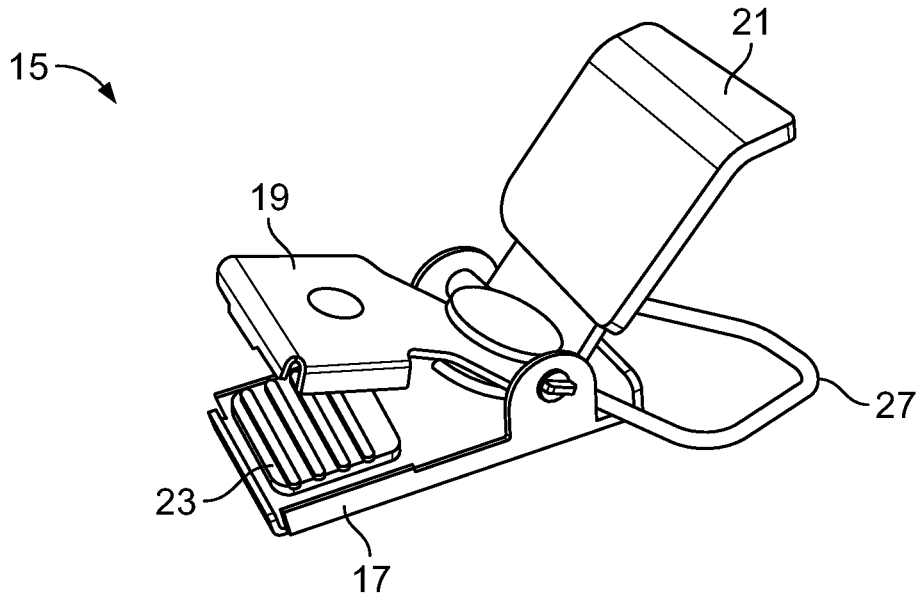
FIGS. 18A-18D are views of a clasp that is attached to the cord according to an exemplary embodiment of the present invention.
Figure 18B:
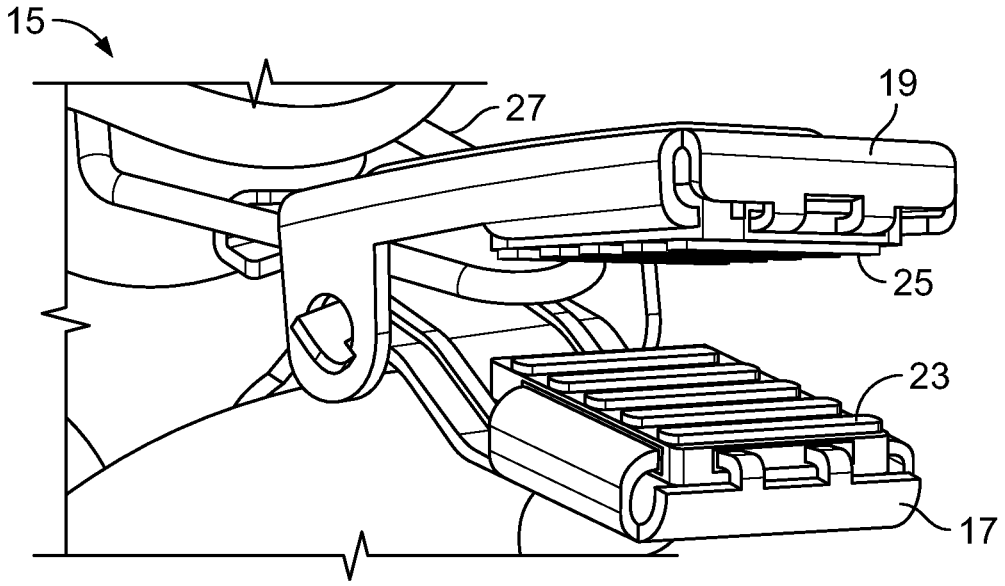
Figure 18C:
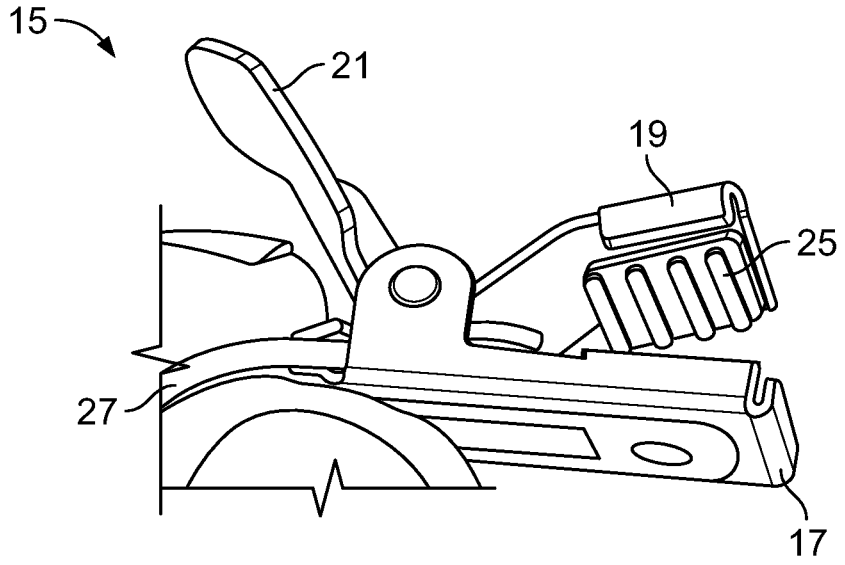
Figure 18D:
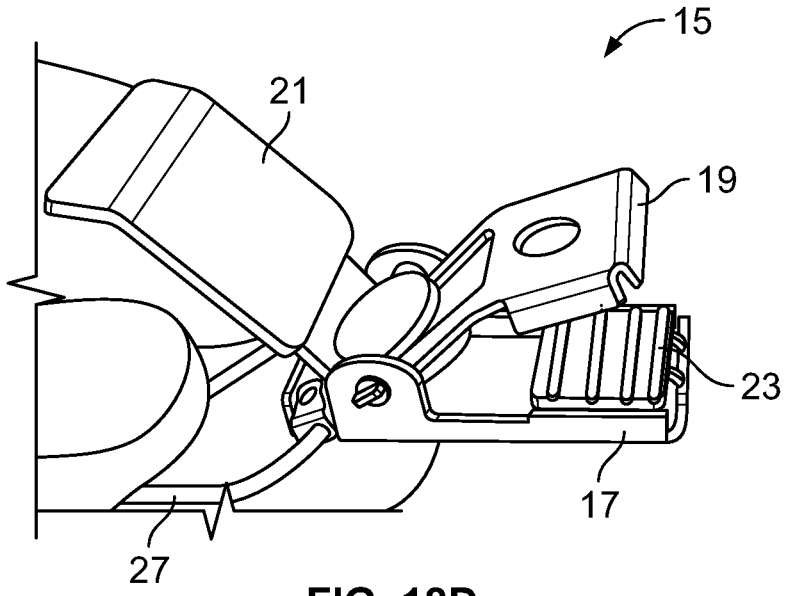

FIGS. 11-13 depict the rear housing 36. The rear housing 36 includes an opening 41 that extends therethrough and a sidewall 43 that extends from a rear side 45 thereof. The sidewall 43 is substantially cylindrical and includes a plurality of channels 47 that are spaced from each other. The channels 47 are configured to interact with tabs 120 that protrude from the cap 34 to aid in positioning the cap 34 in relation to the other elements of the fastener pull apparatus 10 and to preclude the cap 34 from rotating. If the cap 34 was permitted to rotate within the rear housing 36, the cap 34 together with the spool plate 30 would not be capable of preventing the cord 14 from retracting, if desired. As shown in FIGS. 11 and 12, the rear housing 36 and the sidewall 43 are a one-piece molded element. However, it is contemplated that these elements can be independent elements of each other.

Figure 5:
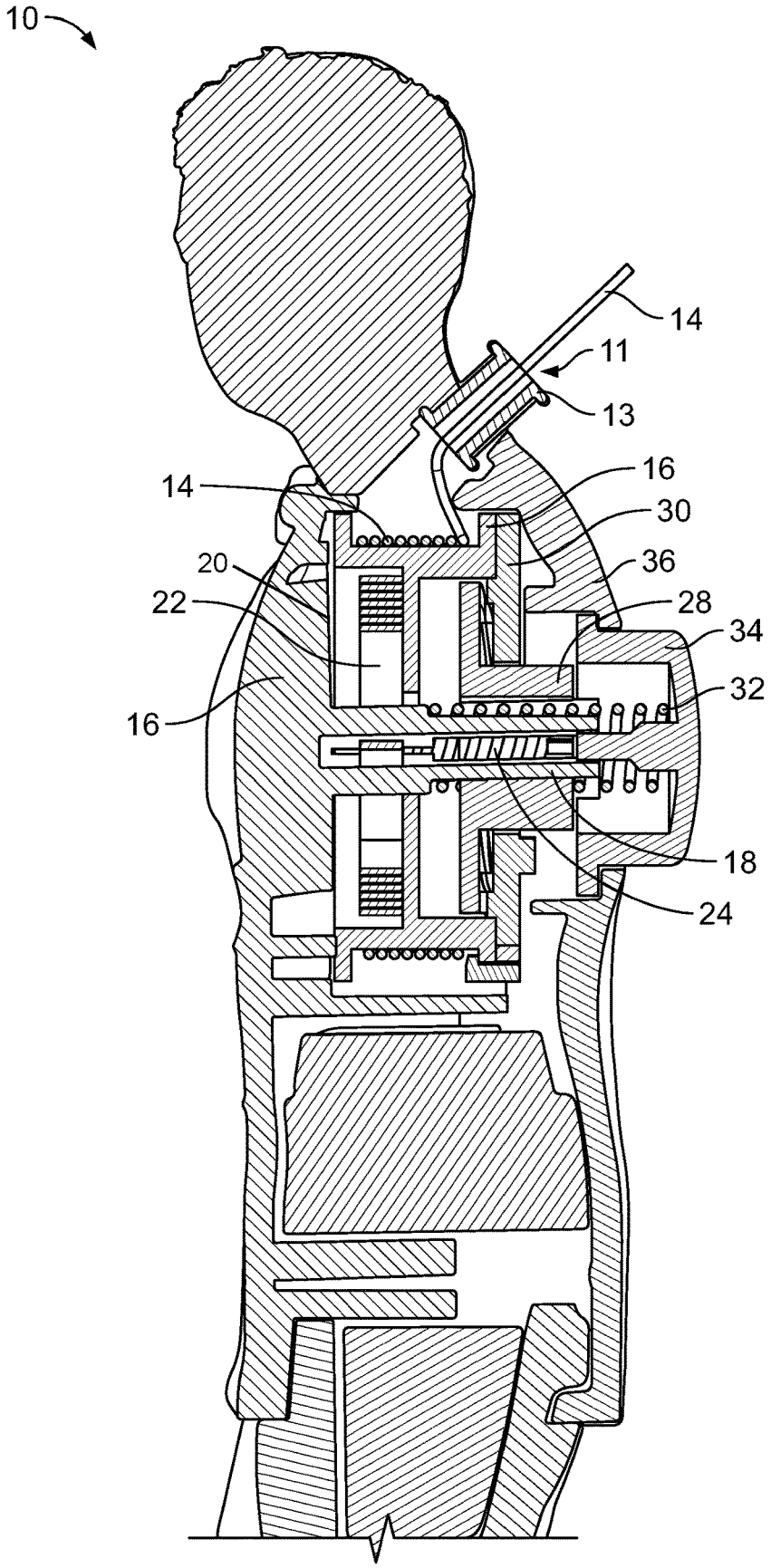
FIG. 5 is a partial cross-sectional view of the fastener pull assist apparatus according to an exemplary embodiment of the present invention.
Figure 6:
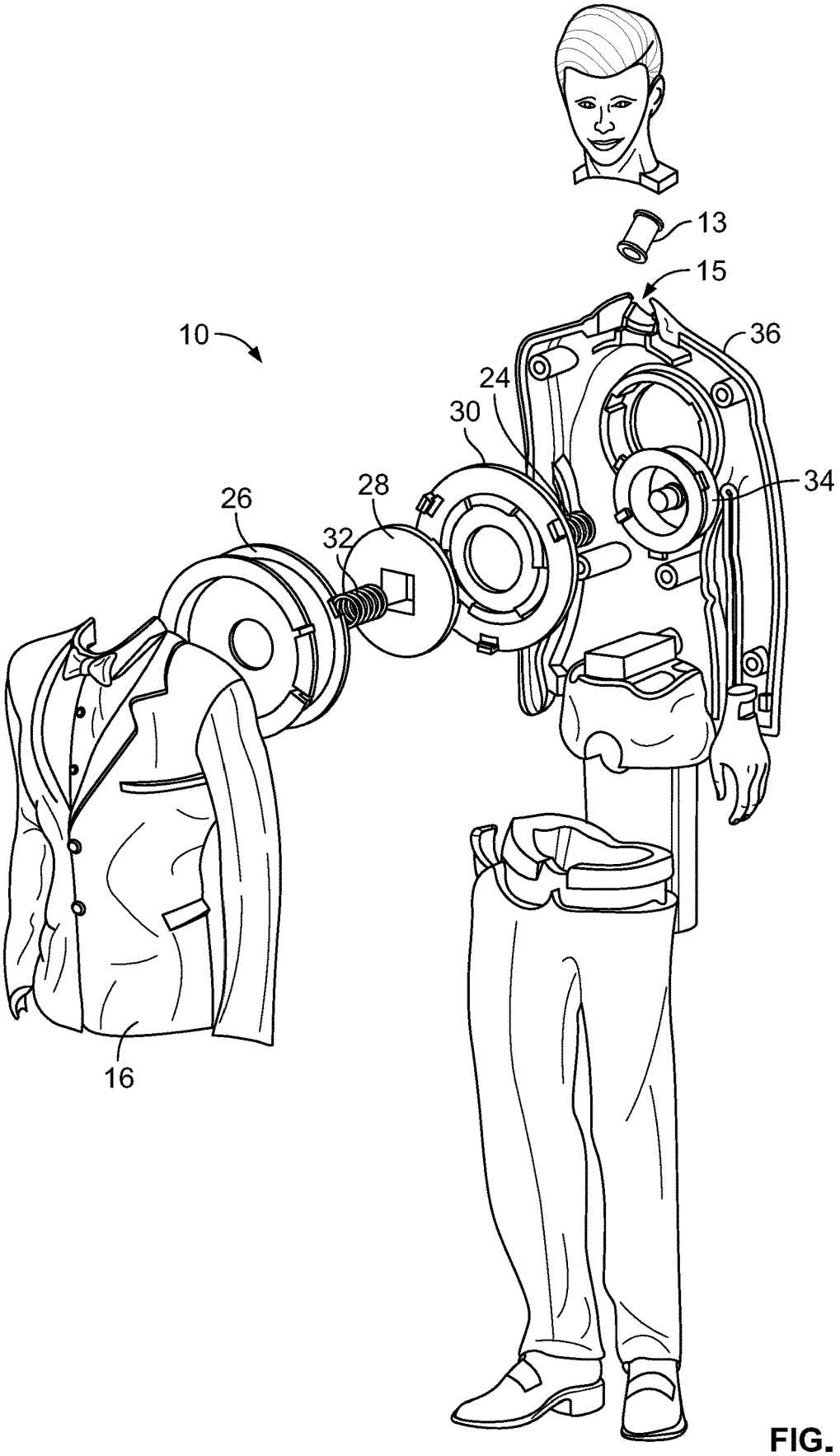
FIG. 6 is an exploded perspective view of various components of the fastener pull assist apparatus according to an exemplary embodiment of the present invention.
Figure 7:
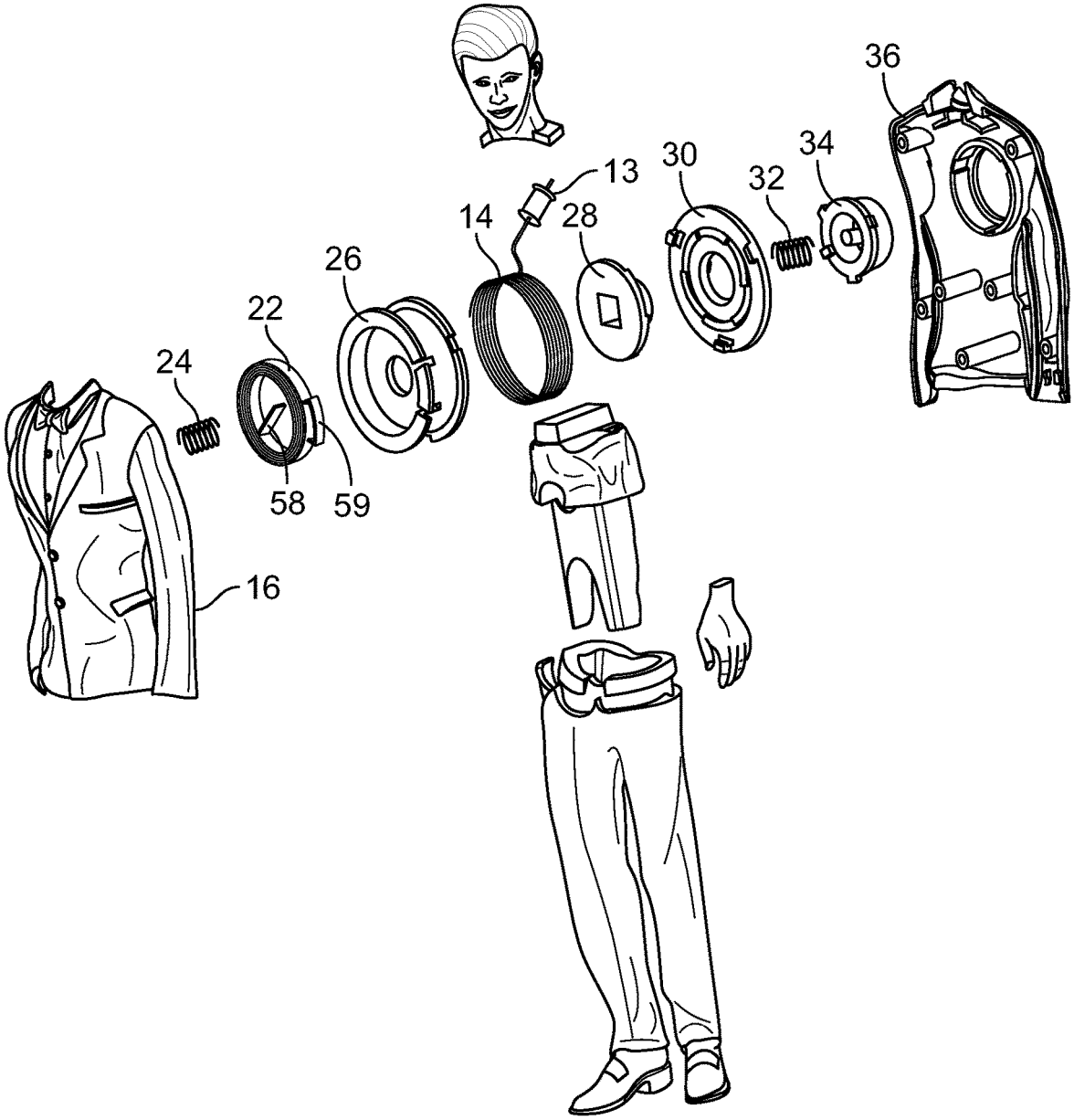
FIG. 7 a partial front exploded view of various components of the fastener pull assist apparatus according to an exemplary embodiment of the present invention.
Figure 8:
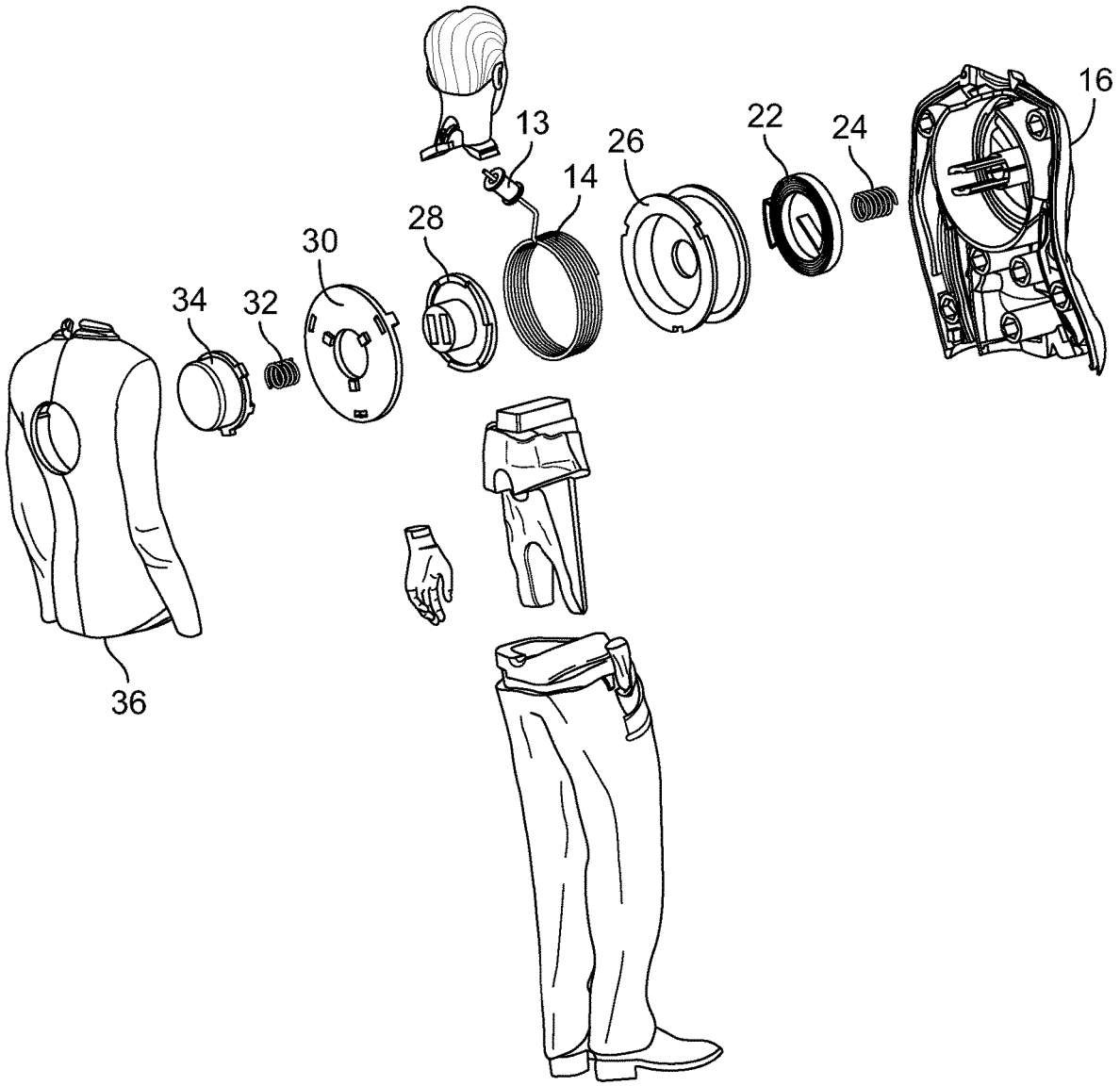
FIG. 8 a partial rear exploded view of various components of the fastener pull assist apparatus according to an exemplary embodiment of the present invention.

FIGS. 14A-14D depict various views of the spool 26. The spool 26 includes a cylindrical body 60 that has an outer surface 62 around which the cord 14 can be wound, an inner surface 64 opposing the outer surface 62, a first rim 66 extending in a first direction from and delimiting a first end of the spool 26, a second rim 68 extending in the first direction from and delimiting a second end of the spool 26 and a wall 70 that has a hole 72 through which the shaft 18 projects, extending at approximately a midpoint of the inner surface 64 of the spool 26 and that separates the space within the spool 26 into a first cavity 74 and a second cavity 76. The spool 26 further includes a plurality of slits 78 to aid in securing a second end 59 of the flat coil or clock spring 22 and a plurality of recesses 80 that, as will be discussed below, are configured to interact with and secure the spool plate 30 to the spool 26. As shown in FIG. 5, the flat coil or clock spring 22 is arranged or nested within the first cavity 74 of the spool 26 and the retracting button 28 is arranged within the second cavity 76 of the spool 26.

The shaft spring 24, as depicted, for example, in FIGS. 5 and 7-9 is sized and configured to be arranged within the gap 50 located between the first projection 46 and second projection 48 of the shaft 18, positionable within the gap 50 by the grooves 52, 54 of the first and second projection, respectively, and contactable with the flat coil or clock spring 22, contactable at a first end with the base 44 of the shaft 18 and contactable at a second end with the wall 70 of the spool 26 that divides the inner area of the spool 26 into the first cavity 74 and the second cavity 76.

FIGS. 15A-15F show various views of the retracting button 28, which is configured to be arranged in an assembled state in the second cavity 76 of the spool 26 (see FIG. 5). The retracting button 28 generally includes a hub 82 and a flange 84 that extends about the outer periphery of the hub 82. The hub 82 includes a first slotted opening 86 and a second slotted opening 88 that is spaced from the first slotted opening 86 extending through a first surface 90 of the hub 82 and a substantially square shaped opening 92 extending through a second surface 93 of the hub 82. The shape of the substantially square shaped opening 92 can vary such that the corners of the opening 92 are rounded. The substantially square shaped opening 92 and the first and second slotted openings 86, 88 are configured to interact with the shaft 18 and the first and second projection 46, 48 such that the shaft 18 and projections 46, 48 can extend through the opening 92 and the first projection 46 can extend through one of the first slotted opening 86 or the second slotted opening 88 and the second projection 48 can extend through the other of the first slotted opening 86 or the second slotted opening 88. In an assembled state, the shaft 18 and in turn projections 46, 48 cannot rotate within the square shaped opening 92, the first slotted opening 86 or the second slotted opening 88.

The flange 84 includes a plurality of ramps or teeth 94 that extend about a first surface 96 of the flange 84. As will be described in more detail below, the ramps or teeth 94 of the retracting button 28 are configured to releasably engage mating ramps or teeth 98 of the spool plate 30.

As depicted in FIGS. 16A-16F, the spool plate 30 includes a disk-shaped housing 100 that has a first surface 102 and a second surface 104 and an opening 106 through which the shaft 18 can extend in an assembled state. A plurality of tabs 108, which are spaced from each other, extend from the first surface 102 at an outer periphery thereof. The tabs 108 are configured to interact with the plurality of recesses 80 formed in the first rim 66 of the spool 26 to fix the spool plate spool plate 30 to the spool 26 and secure the retracting button 28 between the spool 26 and the spool plate 30. As show in FIG. 16B, a plurality of tabs or stops 112 extend from the second surface 104.

FIGS. 17A-17E illustrate various views of the cap 34. The cap 34 includes a pot-shaped housing 114 forming a cavity 116 therein, a flange 118 that extends from the open end of the housing 114, a plurality of tabs 120 that extend from the an outer periphery of the flange 118 and at least one projection or stop 122 that extends from the flange 118 and is configured to interact with the tabs 112 of the spool plate 30 when the cap 34 is depressed more than ⅔ of the total possible travel of the cap 34 toward the front housing 16 to preclude retraction or extension of the cord 14. The at least one projection 122 is arranged to be located between two of the tabs 112 of the spool plate 30 when the cap 34 contacts the spool plate 30. Because the spool plate 30 is fixed to the spool 26, when the at least one stop 122 contacts one of the tabs 112 of the spool plate 30, the stop 112 indirectly precludes rotation of the spool 26 and in turn prevents the cord 14 from extending or retracting from the figurine 12. Although one stop 122 is shown, the cap 34 can include a plurality of stops 122 that can be interspersed between the tabs 112. The cap 34 further includes a post 124 about which the shaft spring 24 can be arranged in an assembled state.

FIGS. 18A-18D are directed to an embodiment of the clasp 15. As shown, the claps 15 includes a first arm 17, a second arm 19 that is rotatable with respect to the first arm 17 and a third arm 21 that is rotatable with respect to the first arm 17 and the second arm 19. The first arm 17 includes a first surface 23 and the second arm 19 includes a second surface 25 that opposes the first surface 23. In use, an object, such as a pull-tab of a zipper, is placed between the first surface 23 and the second surface 25 and the third arm 21 is configured to releasably secure the first arm 17 and second arm 19 to each other and the object (e.g., pull-tab) between the surfaces 23, 25. A hook 27 is attached to the clasp 15 and is contactable to the cord 14. The apparatus 10 can be pulled user in the direction desired. For a dress that includes a zipper, the pull-tab is grasped by the clasp 15 and pulled such that the zipper slider moves in a direction to join the teeth that extend from each side of a zipper tape, sealing the zipper. The pull-tab can then be released from the clasp 15.

In operation, an individual can grasp the housing 12 in one hand and the cord 14 and/or the clasp 15 in the other and pull on the cord 14 and/or clasp 15 to extend the cord 14 out of the housing 12. This in turn simultaneously causes the spool 26 to rotate and the flat coil or clock spring 22 to wind and contract, and increase tension on the fastener pull apparatus 10. The tensioning of the system 10 precludes the cord 14 from being freely retracted after being extended from the housing 12. The cord 14 is only permitted to extend from the housing 12 if the cap 34 is not depressed because the shaft spring 24, which is arranged within the cavity 50 of the shaft 18, is configured to abut the second surface 93 of the retracting button 28, applying pressure thereto which keeps the ramps or teeth 110 of the button 28 engaged with the ramps or teeth 94 of the spool plate 30. Because the spool plate 30 is fixed to the spool 26, by keeping the ramps or teeth 94, 110 engaged with each other, the spool 26 is prevented from rotating and as such, the clock spring 22 is precluded from expanding to a rest state and rewinding the cord 14 about the spool 26. Additionally, it is noted that the retraction button 28 is precluded from rotation by the shaft 16 due to geometry of the features of the retraction button 28 and the shaft 16. As noted above, the retraction button 28 first slotted opening 86 and a second slotted opening 88 and a substantially square shaped opening 92 extending through a second surface 93. When the shaft 16 is arranged within the openings 86, 88, 92, due to the rectangular shape of the openings 86, 88 in the hub 82 and the square shaped opening 92, the retraction button 28 is precluded from rotation about the shaft 16.

To retract the cord 14, the cap 34 must be depressed. The cord 14 will retract as the cap 34 is depressed and travels up to about ⅔ of its total possible travel distance along an axis of the apparatus 10. The cord 14 is able to retract upon partial depression of the cap 34 because the second spring 32 has a higher spring rate that the first spring 24 and as such, is able to overcome the spring force of the first spring 24, compressing the first spring 24 and in turn permitting the ramps or teeth 94 of retraction plate 28 to become disengaged from the ramps or teeth 110 of the spool plate 30 (i.e., the retraction plate 28 can move about the second cavity 76 of the spool 26). By disengaging the connection between the ramps or teeth 94, 110, the spool plate 30 no longer restricts rotation of the spool 26 to which the spool plate 30 is fixed, allowing the tension placed on the flat coil or clock spring 22 to be released and the spool 26 to rotate and wind the cord 14 about the sidewall 60 thereof.

If the cap 34 is depressed beyond ⅔ of the total possible travel distance along the axis of the apparatus 10, the retraction button 28 stops traveling away from the spool plate 28 (i.e., it bottoms out against the wall 70 of the spool) and the second spring 32 begins to compress. The cap 34 continues to travel toward the front housing member 16. The stop 122 of the cap 34 contacts the spool plate 30, between two of the projections 112 of the spool plate 30 and contacts one of the projections 122 which prevents rotation of the spool 26 in either direction and in turn the cord 14 will be prevented from being extended from the housing 12 or being retracted therein.

Although the description above and accompanying drawings contains much specificity, the details provided should not be construed as limiting the scope of the embodiments, but merely as describing some of the features of the embodiments. The description and figures should not to be taken as restrictive and are understood as broad and general teachings in accordance with the present invention. While the embodiments have been described using specific terms, such description is for illustrative purposes only, and it is to be understood that modifications and variations to such embodiments, including, but not limited to, the substitutions of equivalent features and terminology may be readily apparent to those of skill in the art based upon this disclosure without departing from the spirit and scope of the invention.

What is claimed is:

1. A fastener pull assist apparatus, comprising:

a housing;

a spooling mechanism arranged within the housing; and a fastening assembly that is fixed to the spooling mechanism and releasably fixable to an object to aid in pulling the object, wherein the spool mechanism includes a spool about which a cord is windable, a spool plate that is fixable to the spool, a retraction button that is arranged between the spool and the spool plate, a cap that is contactable with the spool plate and a plurality of springs.

2. The fastener pull assist apparatus of claim 1, wherein the housing includes a front housing member and a rear housing member that are fixable to each other and define a cavity therein.

3. The fastener pull assist apparatus of claim 2, wherein the front housing member includes a shaft extending therefrom that includes a first projection and a second projection that is spaced from the first projection such that a cavity is formed between the first projection and the second projection.

4. The fastener pull assist apparatus of claim 3, wherein the spool has an opening extending therethrough, the retraction button has an opening extending therethrough, the spool plate has an opening extending therethrough and the cap has an opening extending therein and the shaft is configured to extend through the opening of the spool, the opening of the retraction button, the opening of the spool plate and the opening in the cap to align the spool, the retraction button, the spool plate and the cap in relation to each other about an axis.

5. The fastener pull assist apparatus of claim 3, wherein the plurality of springs include a first spring that is arranged within a cavity of the shaft.

6. The fastener pull assist apparatus of claim 1, wherein the housing is part of a decorative element.

7. The fastener pull assist apparatus of claim 1, wherein the plurality of springs include a first spring, a second spring and a third spring, the first spring being a coil spring, the second spring being a coil spring having a spring rate that is greater than that of the first spring and the third spring being a clock spring.

8. The fastener pull assist apparatus of claim 1, wherein the spool includes a cylindrical sidewall that has a first surface and a second surface that is mirror opposite the first surface and a wall extending from the second surface, dividing an interior of the spool into a first cavity and a second cavity.

9. The fastener pull assist apparatus of claim 1, wherein the retraction button includes a flange and a plurality of ramps extending about the flange and projecting therefrom.

10. The fastener pull assist apparatus of claim 1, wherein the retraction button includes a hub that has a first slotted opening and a second slotted opening and a flange that includes a plurality of ramps.

11. The fastener pull assist apparatus of claim 1, wherein the spool plate includes a body that that includes a plurality of ramps that extend from a first surface, at least one fastener that extends from the first surface and at least one projection extending from a second surface.

12. The fastener pull assist apparatus of claim 1, wherein the cap includes a housing, a flange extending from an end of the housing and at least one stop extending from the flange.

13. A fastener pull assist apparatus, comprising:

a first housing having a shaft extending therefrom;

a second housing configured to be connectable with the first housing and form a cavity therein; and a spool system arranged between the first housing and the second housing that includes a spool about which a cord is windable, a spool plate fixed to the spool, a retraction button arranged between the spool and the spool plate, a cap configured to interact with the spool plate and a plurality of springs.

14. The fastener pull assist apparatus of claim 13, wherein the shaft includes a first projection and a second projection that is spaced from the first projection such that a cavity exists between the first projection and the second projection.

15. The fastener pull assist apparatus of claim 13, wherein, in an assembled first state, one of the plurality of springs is arranged within a cavity of the shaft and contactable with the retraction button and in turn the retraction button is contactable with the spool plate, allowing for rotation of the spool system in a first direction, wherein, in a second state, upon partial depression of the cap, the retraction button is spaced from the spool plate, permitting the spool to rotate in a second direction and wherein, in a third state, upon full depression of the cap, the cap contacts and interacts with the spool plate, preventing rotation of the spool in the first direction and the second direction.

16. A method of moving a slidable fastener, comprising:

providing a housing and a spool system arranged within the housing that includes a spool about which a cord is windable, a spool plate fixed to the spool, a retraction button arranged between the spool and the spool plate, a cap configured to interact with the spool plate and a plurality of springs;

pulling the cord to extend a length of the cord exterior of the housing;

depressing the cap partially to retract the cord within the housing; and depressing the cap fully to prevent rotation of the spool and in turn retraction or extension of the cord.

* * * * *